US006146116A

United States Patent [19]

Wu et al.

[11] Patent Number: 6,146,116

[45] Date of Patent: Nov. 14, 2000

[54] PUMPING DEVICE WITH A PIVOTAL LEVER FOR VARIOUS VALVES

[76] Inventors: Scott Wu; Louis Chuang, both of P.O. Box 63-247, Taichung, Taiwan

[21] Appl. No.: 09/188,277

[22] Filed: Nov. 9, 1998

Related U.S. Application Data

[63] Continuation-in-part of application No. 08/957,966, Oct. 21, 1997, abandoned.

[51] Int. Cl.[7] ..... F04B 39/10; F16K 15/20

[52] U.S. Cl. ..... 417/569; 137/231; 137/223

[58] Field of Search ..... 137/223, 231; 417/569

[56] References Cited

U.S. PATENT DOCUMENTS

| | | | |
|---|---|---|---|
| 3,926,205 | 12/1975 | Gourlet | 137/223 |
| 5,379,796 | 1/1995 | Wang | 137/231 |
| 5,666,990 | 9/1997 | Wu | 137/223 |
| 5,715,554 | 2/1998 | Downs et al. | 7/138 |
| 5,749,392 | 5/1998 | Glotin | 137/231 |
| 5,819,781 | 10/1998 | Wu | 137/231 |
| 5,890,659 | 4/1999 | Schoeffel et al. | 239/533.2 |

*Primary Examiner*—Charles G. Freay
*Assistant Examiner*—Michael K. Gray
*Attorney, Agent, or Firm*—Charles E. Baxley, Esq.

[57] ABSTRACT

A pumping device includes a main body having a passage defined therein and communicated with an air source. A retainer is slidably received in the main body and includes a chamber communicated with the passage of the main body. A nozzle is received in the chamber of the retainer and includes a nozzle passage communicated with the chamber. A plastic nozzle head is securely mounted in the main body and includes a valve chamber defined therein and communicated with the nozzle passage. A lever is provided for switching the retainer between a first inoperative position and a second operative position in which when the retainer is switched to the second operative position, the retainer exerts an inward force upon an outer periphery of the plastic nozzle head.

16 Claims, 6 Drawing Sheets

PUMPING DEVICE WITH A PIVOTAL LEVER FOR VARIOUS VALVES

CROSS REFERENCE TO RELATED APPLICATION

This is a continuation-in-part application of U.S. patent application Ser. No. 08/957,966 filed on Oct. 21, 1997, now abandoned.

BACKGROUND OF THE INVENTION

1. Field of the Invention

The present invention relates to a pumping device which includes a pivotal lever for various valves.

2. Description of the Related Art

Various pumping devices have heretofore been provided for inflating bicycle tires. Since there are many kinds of valves for bicycle tires, e.g., French valve, Japanese valve, American valve, and English valve. A so-called "double head" type pump with a switch means has been proposed to be used on these different valves. Nevertheless, the conventional pumping devices often have complicated structures and require troublesome operation to suit different valves. A conventional bicycle air pump head, as illustrated in FIGS. 13 and 14 of U.S. Pat. No. 5,379,796 issued on Jan. 10, 1995 to Wang, uses a pressing member 52 pivoted to an upper portion of a cylindrical body. As indicated by Wang, the pressing member 52 must be pressed and turned to cause the elastic body 56 to engage the tire air valve, and such an action hampers the pumping action. In addition, the air pump head can be used with only one type of valves. More specifically, the pressing member 52 must be changed in order to be used with other types of valves. However, Wang also did not disclose any solution for an air pump that can be used with different types of valves. U.S. Pat. No. 5,749,392 to Glotin discloses an air pump that has a large chamber for receiving two types of tire air valves. This results in a complicated structure and the overall structure is too large. The present invention is intended to provide an improved pumping device that mitigates and/or obviates the above-mentioned problems.

SUMMARY OF THE INVENTION

In accordance with the present invention, a pumping device comprises:

a main body having a passage defined therein and adapted to be communicated with an air source, the main body further including a compartment defined therein and communicated with the passage, a retainer slidably received in the compartment of the main body, the retainer including a chamber defined therein and communicated with the passage of the main body, the retainer further including a positioning member pivotally mounted therein, a nozzle received in the chamber of the retainer and including a nozzle passage communicated with the chamber, a nozzle head securely mounted in the compartment of the main body, the nozzle head including a valve chamber communicated with the nozzle passage and adapted to receive a tire valve, and means for switching the retainer between a first inoperative position and a second operative position, whereby when the retainer is switched to the second operative position, the nozzle is moved to engage with the tire valve inserted into the valve chamber, and the positioning member is pivoted into the chamber of the retainer to stop further inward movement of the tire valve.

An inner periphery defining the compartment of the main body includes a flange formed thereon, and the retainer contacts with and thus stopped by the flange when the retainer reaches the second operative position.

The nozzle head is plastic and includes a conic end, and the retainer includes an end having a conic section defined in an inner periphery thereof for receiving the conic end of the plastic nozzle head. When the retainer is at the second operative position, the conic section of the retainer exerts an inward force upon the conic end of the plastic nozzle head.

An elastic member is mounted in the chamber of the retainer and has a first end attached to the nozzle and a second end attached to an end wall defining the chamber to return the retainer to the first inoperative position.

The retainer further includes an O-ring mounted in an outer periphery thereof to provide a sealing effect.

The retainer includes a recess defined in an outer periphery thereof and communicated with the chamber of the retainer for receiving the positioning member. The main body includes a conic shoulder formed on an inner periphery thereof for moving a portion of the positioning member into the chamber of the retainer. A spring is mounted in the recess for returning the positioning member back into the recess when the retainer is switched to the first inoperative position.

In a preferred embodiment of the invention, the means for switching the retainer is a lever.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
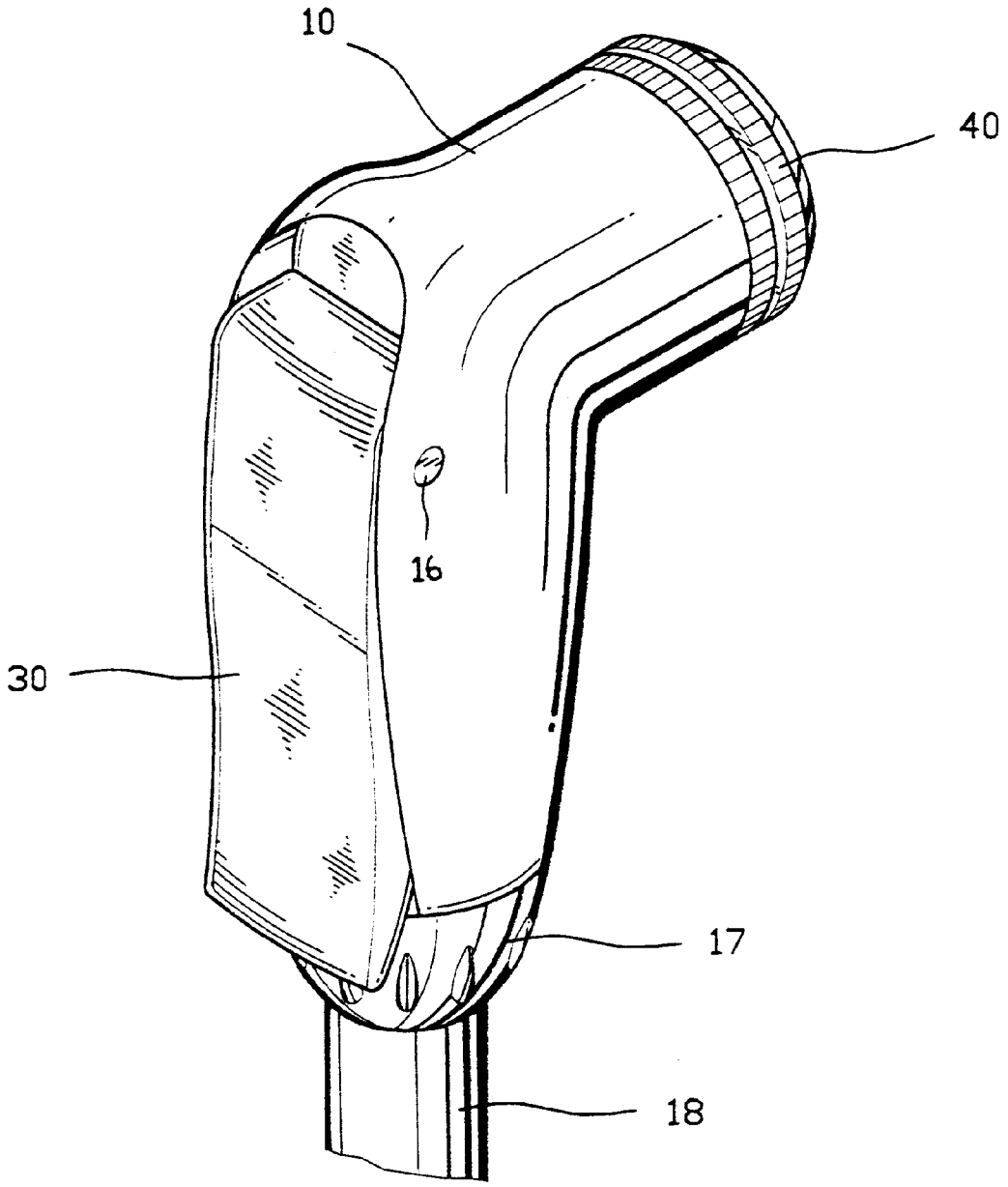
FIG. 1 is a perspective view of a pumping device in accordance with the present invention.
Figure 2:
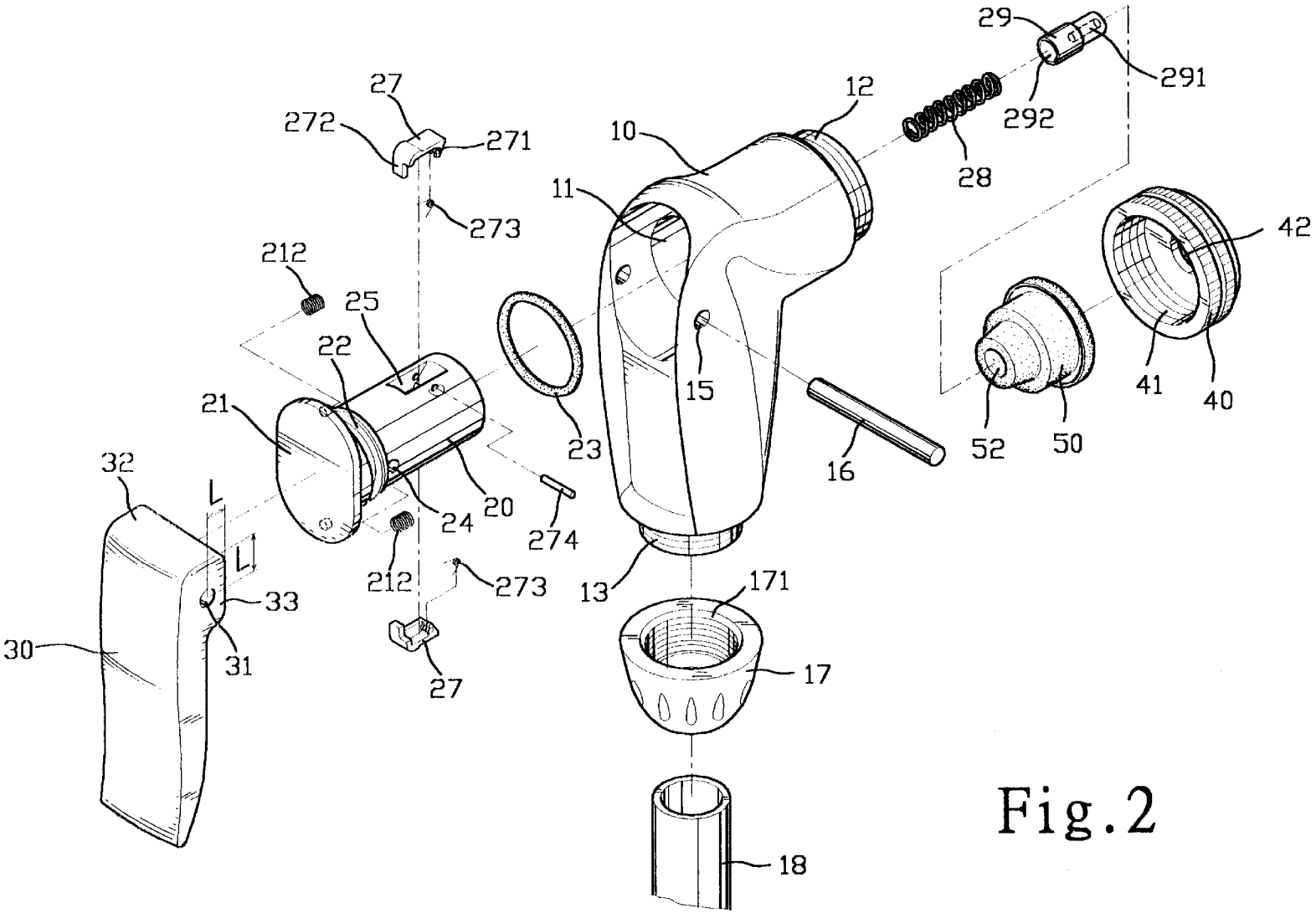
FIG. 2 is an exploded perspective view of the pumping device in accordance with the present invention.
Figure 3:
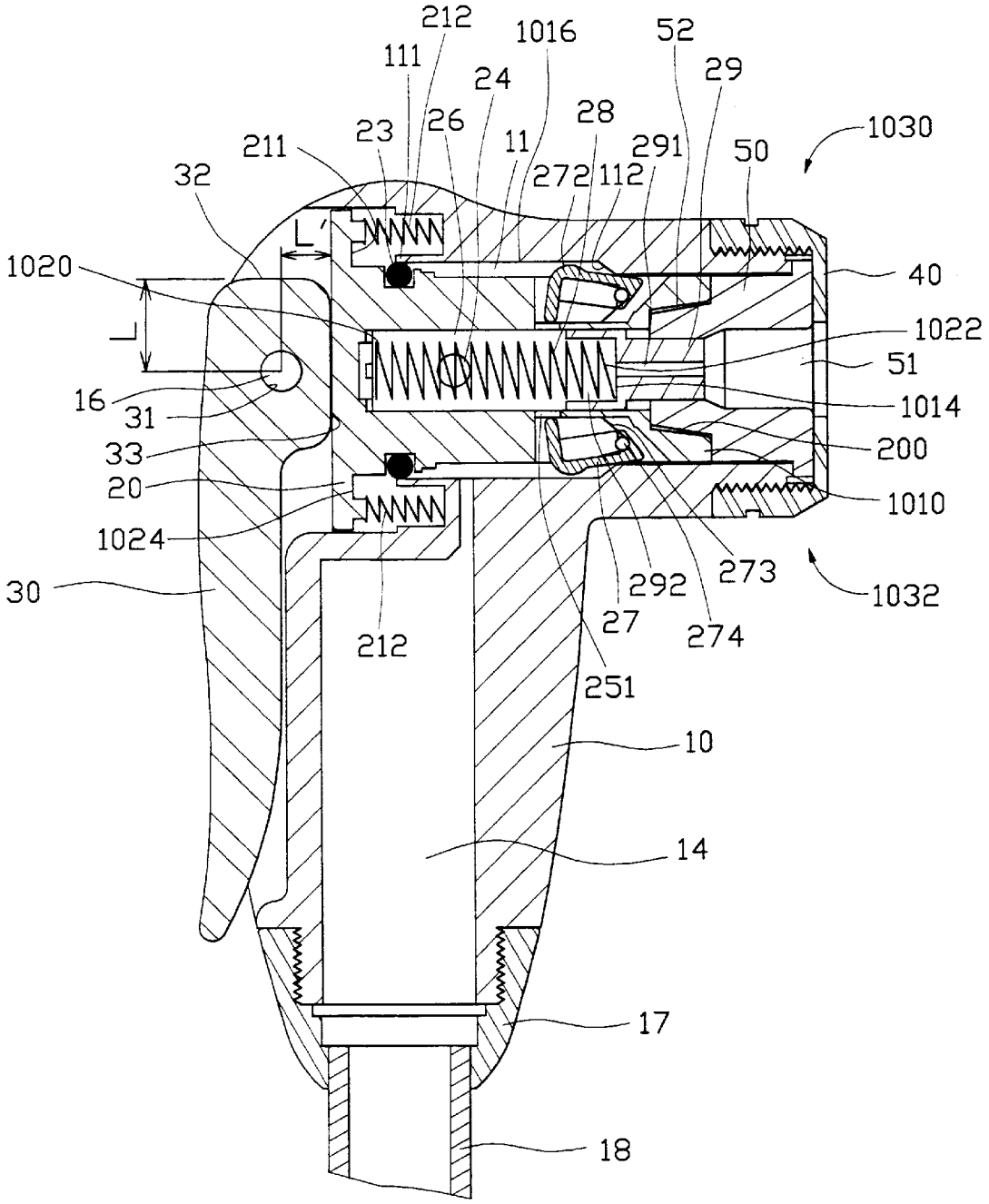
FIG. 3 is a cross-sectional view of the pumping device.

Referring to the drawings and initially to FIGS. 1 to 3, a pumping device for bicycle tires in accordance with the present invention generally includes a substantially L-shaped main body 10 having a compartment 11 defined therein and a passage 14 defined therein for intercommunicating the compartment 11 with an external air source (not shown) via a connecting tube 18 an end of which is secured in position by means of threading engagement between an inner threading 171 (FIG. 2) of a cap 17 and outer threading 13 formed on an end of the main body 10. The passage 14 may be communicated to, e.g., a chamber (not shown) which receives a piston (not shown) therein for pumping air into the passage 14.

A lever 30 is pivotally connected to the main body 10 by means of extending a pin 16 through a pin hole 15 (FIG. 2)

defined in the main body 10 and a pin hole 31 defined in the lever 30. It is appreciated that the lever 30 is so constructed that a distance L between the pin hole 31 and an end face 32 is greater than a distance L' between the pin hole 31 and a lateral face 33 (FIG. 3). A flange 111 is formed on an inner periphery of the main body 10 which defines the compartment 11. The inner periphery which defines the compartment 11 further includes a conic shoulder 112 formed thereon.

Figure 6:
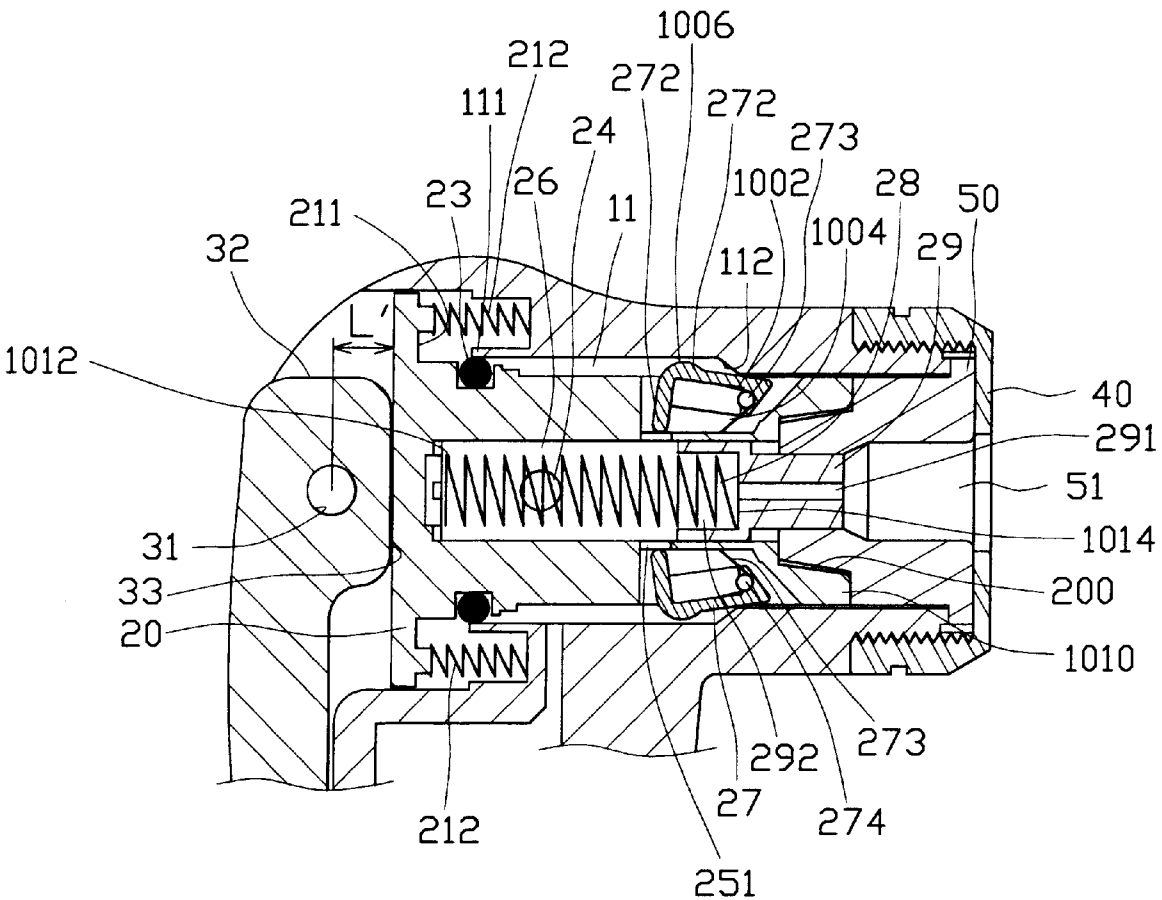
FIG. 6 is a fragmentary cross-sectional view similar to FIG. 3 drawn to an enlarged scale.

A retainer 20 is slidably received in the compartment 11 and includes an enlarged head or first end 21 and an open second end 1010. The open second end of the retainer 20 includes a conic section 200, as shown in FIG. 3. The retainer 20 further includes an annular groove 22 defined in an outer periphery thereof adjacent to the enlarged end 21 for receiving an O-ring 23 so as to provide a sealing effect, best shown in FIG. 3. The retainer 20 further includes a chamber 26 and a transverse hole 24 that intercommunicates with the chamber 26 with the passage 14 of the main body 10. Two recesses 25 are defined in the outer periphery of the retainer 20 for respectively receiving two positioning elements 27. Each positioning element 27 includes a first end 271 pivoted to the retainer 20 (see pin 274 in FIG. 2) and a second end 272 that is movable into the chamber 26 via a passage 251 defined between the recess 25 and the chamber 26. A spring 273 is provided for returning each positioning member 27 into the associated recess 25. In addition, springs 212 are provided between the enlarged end 21 of the retainer 20 and the main body 10 for returning the retainer 20. The spring 273 which is disposed in recess 25 of retainer 20 has a first end portion 1002 and a second end portion 1004. End portion 1002 bears against the positioning member 27 while end portion 1004 bears against the retainer 20. The spring 273 urges the retainer 20 toward the position shown in FIGS. 3 and 6.

Figure 4:
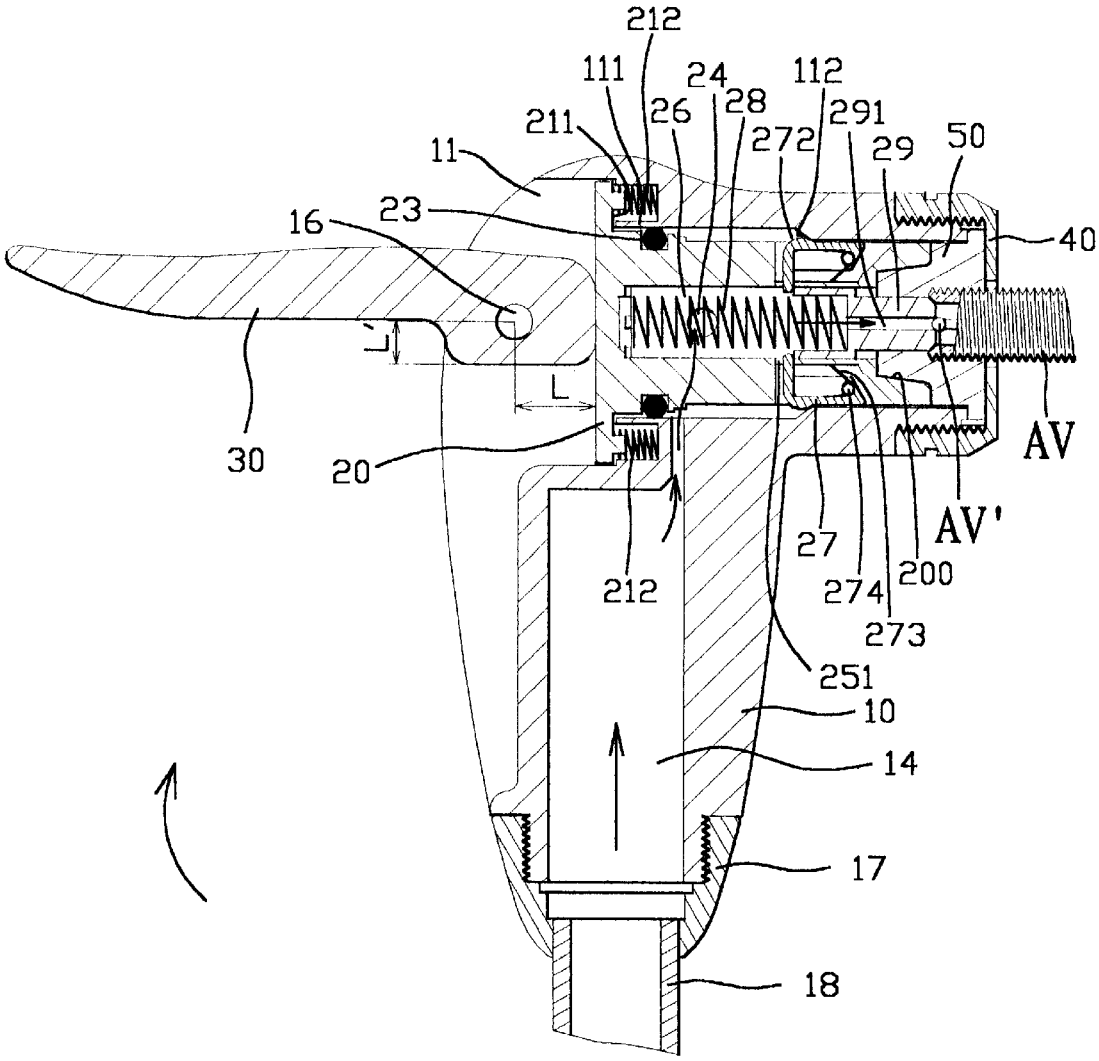
FIG. 4 is a cross-sectional view illustrating operation of the pumping device on an American valve.

Positioning elements 27 are pivotally supported by pins 274 as is shown in FIGS. 1 and 4.

Positioning element 27 includes a section 1006 adjacent to the second end 272. Section 1006 protrudes above a flat planar section 1008 of the positioning member 27 such that when the lever 30 is engaged to actuate the device to the second operative position, the conic shoulder 112 engages the protruding section 1006 thereby rotating the second end 272 into the chamber 26, as is shown in FIG. 4.

The directions of rotation of the positioning members 27 caused by engagement of the conic shoulder 112 is illustrated by the arrows 1030 and 1032 in FIG. 3.

The compartment 11 of the main body 10 is defined by an inner periphery 1016.

The spring 28 has a first end 1020 and a second end 1022.

The retainer 20 has an outer periphery 1050.

A spring 28 and a nozzle 29 are received in the chamber 26 of the retainer 20. As shown in FIG. 3, the nozzle 29 includes a recess 292 defined in a first end thereof for receiving an end of the spring 28 and a second end communicated with the chamber 26 via the recess 292 and having a nozzle passage 291 defined therein.

A nozzle head 50, preferably of plastic material, is mounted in the compartment 11 and is secured in position by means of threading engagement between an inner threading 41 (FIG. 2) of a cap 40 and an outer threading 12 formed on the other end of the main body 10. The nozzle 50 includes a conic end 52 that bears against the conic section 200 of the retainer 20. The nozzle head 50 further includes a valve chamber 51 which communicates with the nozzle passage 291 and which may receive a valve of a bicycle tire which will be further described later. The cap 40 has a central aperture 42.

In operation, referring to FIG. 4, when pumping a tire (not shown) via an American valve AV, the American valve AV is extended into the valve chamber 51, and the lever 30 is pivoted, e.g., clockwise through 90 degrees. Since L is greater than L', the retainer 20 is moved toward the American valve AV until a bottom wall 1024 defining an annular groove 211 defined in the enlarged head 21 of the retainer 20 is stopped by the flange 111. Meanwhile, the nozzle 29 engages with a needle (AV') of the American valve AV under the action of the spring 28. The second ends 272 of the positioning elements 27 are pivoted inwardly into the chamber 26 under the action of the conic shoulder 112 to stop further inward movement of the American valve AV. It is appreciated that the conic section 200 of the retainer 20 exerts an inward force to the conic end 52 of the nozzle head 50 to retain the American valve AV in place during the inflation procedure. As a result, the American valve AV is retained in place during the inflation procedure in which air from the passage 14 enters the American valve AV via the transverse hole 24, the chamber 26, and the nozzle passage 291. After inflation, the lever 30 is pivoted back to its initial inoperative position, and the retainer 20 is returned under the action of the springs 28 and 212.

Figure 5:
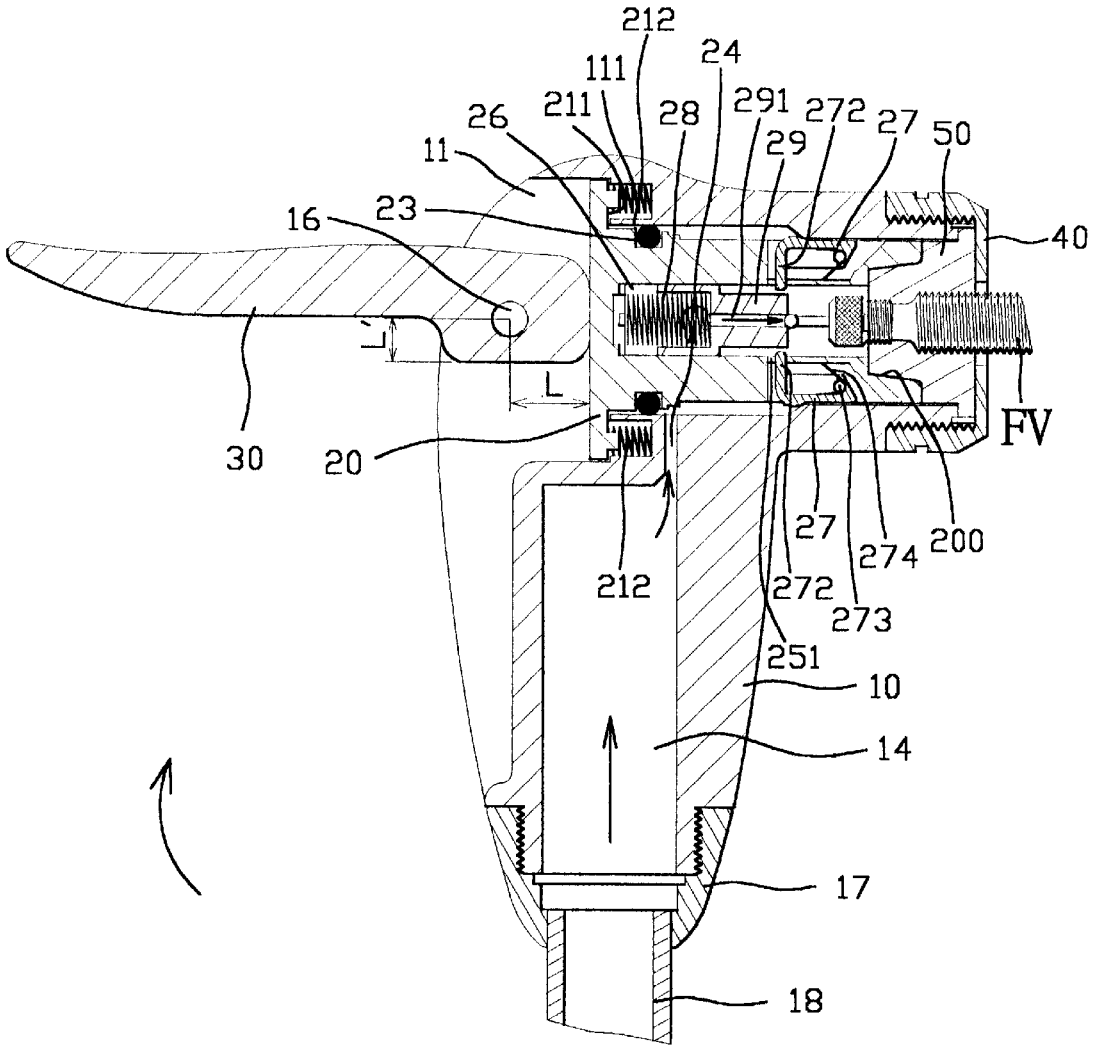
FIG. 5 is a cross-sectional view illustrating operation of the pumping device on a French valve.

Referring to FIG. 5, when pumping a tire (not shown) via a French valve FV, the French valve FV is extended into the valve chamber 51, and the lever 30 is pivoted clockwise through 90 degrees. Again, since L is greater than L', the retainer 20 is moved toward the French valve FV until the bottom wall defining the annular groove 211 defined in the enlarged head 21 of the retainer 20 is stopped by the flange 111. Meanwhile, the nozzle 29 engages with the French valve FV under the action of the spring 28. The second ends 272 of the positioning elements 27 are pivoted inwardly into the chamber 26 by the conic shoulder 112 yet not contacting with the French valve FV as the French valve FV is shorter than the American valve. As shown in FIG. 5, the nozzle 29 is positioned at a location to engage with a needle valve (not labeled) of the French valve FV to allow smooth inflation operation. It is appreciated that the conic section 200 of the retainer 20 exerts an inward force to the conic end 52 of the nozzle head 50 to retain the French valve FV in place during the inflation procedure. Air from the passage 14 enters the French valve FV via the transverse hole 24, the chamber 26, and the nozzle passage 291.

According to the above description, it is appreciated that the pumping device may be used on various valves by simple operation of the same lever. In particular, the user does not have to recognize the type of the valve before inflation; instead, the user may simply insert the valve into the valve chamber 51.

Although the invention has been explained in relation to its preferred embodiment, it is to be understood that many other possible modifications and variations can be made without departing from the spirit and scope of the invention as hereinafter claimed.

What is claimed is:

1. A pumping device comprising:

a main body having a passage defined therein and adapted to be communicated with an air source, the main body further including a compartment defined therein and communicated with the passage, a retainer slidably received in the compartment of the main body, the retainer including a chamber defined therein and communicated with the passage of the main body, the retainer further including a positioning member pivotally mounted therein, a nozzle received in the chamber of the retainer and including a nozzle passage communicated with the chamber, a nozzle head securely mounted in the compartment of the main body, the nozzle head including a valve chamber communicated with the nozzle passage and adapted to receive a tire valve, and means for switching the retainer between a first inoperative position and a second operative position, whereby when the retainer is switched to the second operative position, the nozzle is moved to engage with the tire valve inserted into the valve chamber, and the positioning member is pivoted into the chamber of the retainer to stop further inward movement of the tire valve.

2. The pumping device according to claim 1, wherein an inner periphery defining the compartment of the main body includes a flange formed thereon, and the retainer contacts with and thus is stopped by the flange when the retainer reaches the second operative position.

3. The pumping device according to claim 1, wherein the nozzle head is plastic and includes a conic end, and the retainer includes an end having a conic section for receiving the conic end of the plastic nozzle head, and when the retainer is at the second operative position, the conic section of the retainer exerts an inward force upon the conic end of the plastic nozzle head.

4. The pumping device according to claim 1, further comprising an elastic member mounted in the chamber of the retainer, the elastic member having a first end attached to the nozzle and a second end attached to an end wall defining the chamber to return the retainer to the first inoperative position.

5. The pumping device according to claim 1, wherein the retainer further includes an O-ring.

6. The pumping device according to claim 1, wherein the retainer includes a recess defined in an outer periphery thereof and communicated with the chamber of the retainer for receiving the positioning member.

7. The pumping device according to claim 6, wherein the main body includes a conic shoulder for moving a portion of the positioning member into the chamber of the retainer.

8. The pumping device according to claim 6, further comprising a spring mounted in the recess for returning the positioning member back into the recess when the retainer is switched to the first inoperative position.

9. A pumping device comprising:

a main body having a passage defined therein and adapted to be communicated with an air source, the main body further including a compartment defined therein and communicated with the passage, a lever pivotally connected to the main body, a retainer slidably received in the compartment of the main body and including a first end attached to and actuatable by the lever and thus movable between a first inoperative position and a second operative position, the retainer including a chamber defined therein and communicated with the passage of the main body, the retainer further including a positioning member pivotally mounted therein, a nozzle received in the chamber of the retainer and including a nozzle passage communicated with the chamber, a nozzle head securely mounted in the compartment of the main body and including a valve chamber communicated with the nozzle passage and adapted to receive a tire valve, whereby when the lever is pivoted to urge the retainer to move to the second operative position, the nozzle is moved to engage with the tire valve inserted into the valve chamber, and the positioning member is pivoted into the chamber of the retainer to stop further inward movement of a valve inserted into the nozzle head.

10. The pumping device according to claim 9, wherein an inner periphery defining the compartment of the main body includes a flange formed thereon, and the first end of the retainer includes an annular groove defined therein, and wherein a bottom wall defining the annular groove contacts with the flange when the retainer is in the second operative position.

11. The pumping device according to claim 9, wherein the nozzle head is plastic, and includes a conic portion and the retainer includes a conic section defined in an inner periphery thereof for receiving the conic portion of the plastic nozzle head, and when the retainer is at the second operative position, the conic section of the retainer exerts an inward force upon the conic portion of the plastic nozzle head.

12. The pumping device according to claim 9, further comprising an elastic member mounted in the chamber of the retainer, the elastic member having a first end attached to the nozzle and a second end attached to an end wall defining the chamber to return the retainer to the first inoperative position.

13. The pumping device according to claim 9, wherein the retainer further includes an O-ring mounted in an outer periphery thereof.

14. The pumping device according to claim 9, wherein the retainer includes a recess defined in an outer periphery thereof and communicated with the chamber of the retainer for receiving said at least one positioning member.

15. The pumping device according to claim 14, wherein the main body includes a conic shoulder formed on an inner periphery thereof for moving a portion of the positioning member into the chamber of the retainer.

16. The pumping device according to claim 14, further comprising a spring mounted in the recess for returning the positioning member into the recess when the retainer is switched to the first inoperative position.

* * * * *